US008991091B2

(12) United States Patent
Griffin

(10) Patent No.: US 8,991,091 B2
(45) Date of Patent: Mar. 31, 2015

(54) UNIVERSAL LAUNCHER SYSTEM

(71) Applicant: RM Equipment, Inc., Miami, FL (US)

(72) Inventor: Todd Griffin, Miami, FL (US)

(73) Assignee: RM Equipment, Inc., Miami, FL (US)

( * ) Notice: Subject to any disclaimer, the term of this patent is extended or adjusted under 35 U.S.C. 154(b) by 89 days.

(21) Appl. No.: 13/740,902

(22) Filed: Jan. 14, 2013

(65) Prior Publication Data

US 2015/0000173 A1 Jan. 1, 2015

(51) Int. Cl.
*F41C 27/06* (2006.01)

(52) U.S. Cl.
CPC ..... *F41C 27/06* (2013.01)
USPC ..... 42/105

(58) Field of Classification Search
USPC ..... 42/72, 73, 71.01, 75.03, 75.01; 89/128
See application file for complete search history.

(56) References Cited

U.S. PATENT DOCUMENTS

| | | | | | |
|---|---|---|---|---|---|
| 2,483,711 | A | * | 10/1949 | Roos | 396/426 |
| 3,318,192 | A | * | 5/1967 | Sullivan et al. | 89/142 |
| 3,939,589 | A | * | 2/1976 | Tellie | 42/71.01 |
| 4,358,986 | A | * | 11/1982 | Giorgio | 89/142 |
| 4,733,489 | A | | 3/1988 | Kurak | |
| 4,788,785 | A | * | 12/1988 | White | 42/72 |
| 5,235,771 | A | * | 8/1993 | Sokol et al. | 42/105 |
| 5,930,935 | A | | 8/1999 | Griffin | |
| 6,134,823 | A | | 10/2000 | Griffin | |
| 7,328,530 | B2 | | 2/2008 | Griffin | |
| 7,673,412 | B2 | | 3/2010 | Griffin | |
| 7,827,721 | B2 | | 11/2010 | Griffin | |
| 7,891,130 | B2 | | 2/2011 | Griffin | |
| 8,286,382 | B2 | * | 10/2012 | Vesligai | 42/75.03 |
| 2010/0162608 | A1 | * | 7/2010 | McCann | 42/71.01 |
| 2011/0198471 | A1 | * | 8/2011 | Marquez | 248/316.4 |
| 2014/0007763 | A1 | * | 1/2014 | Foster | 89/136 |

FOREIGN PATENT DOCUMENTS

WO WO-2012099876 A1 7/2012

* cited by examiner

*Primary Examiner* — Reginald Tillman, Jr.
(74) *Attorney, Agent, or Firm* — Nawrocki, Rooney & Sivertson, P.A.

(57) ABSTRACT

A launcher system, advantageously in kit form, is provided. The system generally includes a launching device, a pistol grip frame, and stock assembly. The pistol grip frame is characterized by a frame body and a pistol grip extending therefrom, the frame body having a first frame body portion adapted for select operative union with the launching device, and a second frame body portion adapted for select operative union with the stock assembly. The stock assembly is adapted for select operative union with the second frame body portion of the frame body of the pistol grip frame. No-tool select operator union of elements of the system is enabled.

18 Claims, 5 Drawing Sheets

UNIVERSAL LAUNCHER SYSTEM

TECHNICAL FIELD

The present disclosure generally relates to a launching device, or replica thereof, operative or otherwise, more particularly, to a launcher system, more particularly, to an in-field, no-tool, operator customizable launcher system characterized by a pistol/pistol grip frame or a pistol grip frame and a stock assembly.

BACKGROUND OF THE INVENTION

Adaptability and versatility remain advantageous device characteristics. In the context of hand held devices, adaptations for various use modalities are known and desirable. In the context of launching devices, there exists stand alone launching devices, e.g., hand held launching devices and/or shoulder supported launching devices, and launching devices which are a component or element of a primary device characterized by an enhanced functionality.

In a launching device context, a well known, and well documented example of enhanced functionality, namely, dual functionality, is the M203 40 mm grenade launcher. This single shot launcher was designed as a rifle attachment in order to increase the efficiency with which a soldier could alternate between bullet fire via the "host weapon," and high energy grenade fire which was previously available via use of a dedicated, separate weapon, namely, the M79. Many interface approaches were developed in furtherance of equipping a host weapon with the M203 launcher, both minimally altered solutions (e.g., U.S. Pat. No. 4,733,489 (Kurak), and U.S. Pat. No. 6,134,823 (Griffin)), and unaltered solutions (e.g., U.S. Pat. No. 6,134,823 (Griffin)).

Modular designs, and systems so characterized, have been developed and are generally viewed as advantageous and desirable. For example, RM Equipment, Inc., Miami, Fla. (USA) provides, among other things, an M203PI Enhanced Grenade Launcher Module (EGLM). Unaltered and minimally altered interface solutions, advantageously but not necessarily via an interbar for non-rail interfaces, are provided. Moreover, in a "rail" context or environment (i.e., rails having their origins in military standard "MIL-STD-1913 (AR), 3 Feb. 1995" entitled "Dimensioning of Accessory Mounting Rail for Small Arms Weapon," and an update thereto, namely, "MIL-STD-1913 Update Notice 1, 10 Jun. 1999") a "universal" module is advantageously provided. As shown and described in Applicant's published international application WO 2012/099876 (Appl. No. PCT/US2012/021543), incorporated herein by reference in its entirety, such universal modules are characterized by direct (see e.g., WO 2012/099876, FIG. 1 or 9) or indirect means (see e.g., WO 2012/099876, FIG. 12) to readily, reliably and robustly unite an EGLM or the like with/to, for instance, a host device or tactical mount (see e.g., the M203PI Tactical from RM Equipment; see also, either of U.S. Pat. No. 7,673,412 or 7,827,721, each of which is incorporated herein by reference in their entireties).

As is known and appreciated, virtually any rifle or sub-gun (i.e., a host weapon) can be equipped with a grenade launcher. Again, at least in the context of the M203PI, the EGLM may be added/removed in relation to a host weapon as a supplemental device as easily as changing magazines. Moreover, owing to structural features, a single EGLM may be readily shared by grenadiers carrying different host weapons, and exchanged as needed. Thus, cross-training and tactical operations are not hardware limited, with dedicated grenadiers no longer a necessity as any/all team member(s) may suitably and advantageously have at their ready disposal an easily adapted multifunction device.

Beyond provisions as a supplemental device, there remains a need for dedicated, stand alone functionality, more particularly, a need for improvements with regard to stand alone versatility, namely, versatility in the context of launcher platforms. Platforms, more often than not, generally comprise those characterized by a pistol grip or a pistol grip and a stock/butt stock assembly.

An innovative tactical mount from RM Equipment is characterized by a novel hinge mechanism which permits ready operator conversion between hand/pistol based support/operation and shoulder based support/operation (see e.g., U.S. Pat. No. 7,673,412). While widely viewed as a welcome improvement over a singular firing modality platform, it is believed that a truly universal approach remains outstanding and desirable.

Thus, and broadly, it is desirable to provide a launcher system, characterized by a launching device, operable or otherwise, wherein the launching device may be readily utilized in either of hand held or shoulder supported postures. Moreover, in the non-limiting context of grenade launching, it is believed advantageous to offer a grenade launcher system, advantageously but not necessarily in a kit form or format, generally characterized by a grenade launcher, or replica thereof, operable or otherwise, and a launcher platform readily convertible without tools between either of a hand/pistol based operation/firing, and/or a shoulder based operation/firing, more particularly, to enable a variety of launcher modalities, whether as a supplemental or primary device, via select, no-tool operator structural additions/removals.

SUMMARY OF THE INVENTION

A launcher system, advantageously in kit form, is broadly provided. The system generally includes a launching device, operable or otherwise, a pistol grip frame characterized by a frame body and a pistol grip extending therefrom, and a stock assembly. The frame body has a first frame body portion adapted for select operative union with the launching device, and a second frame body portion adapted for select operative union with a stock assembly. The stock assembly is adapted for select operative union with the second frame body portion of the frame body of the pistol grip frame.

In a preferred, non-limiting embodiment, the system generally includes a grenade launcher, a pistol grip frame, and stock assembly. The grenade launcher is characterized by a launcher body and a barrel assembly. The pistol grip frame is characterized by a frame body and a pistol grip extending therefrom, the frame body having a first frame body portion adapted for select operative union with the grenade launcher, and a second frame body portion adapted for select operative union with the stock assembly. The stock assembly is adapted for select operative union with the second frame body portion of the frame body of the pistol grip frame. No-tool select operator union of elements of the system is enabled.

Provisions are advantageously made for a universal grenade launcher, or facsimille thereof, which may be readily supported, without resort to tool use, to a host structure. In the context of a stand alone weapon platform, a universal, enhanced grenade launcher module is readily and robustly mateable to a tactical mount, more particularly, a tactical mount selectively convertible between primary hand held operation and primary shoulder supported operation. A pistol grip frame includes a portion for operative receipt of the launcher, and a portion for optional operative receipt of a stock assembly. Advantageously, but not necessarily, the stock assembly is characterized by either of or both of a telescoping and folding stock. The interface for, between and among the pistol grip frame and the stock assembly is characterized by reversible locking and tension aided disassociated. An actuator for mechanical means for establishing and maintaining an interference fit for, between and among the pistol grip frame and the stock assembly is provided in recessed condition to eliminate inadvertent/unintentional disassociation of the structures. More specific features and advantages obtained in view of those features will become apparent with reference to the drawing figures and DETAILED DESCRIPTION OF THE INVENTION.

BRIEF DESCRIPTION OF THE DRAWINGS

The apparatus, kit, assemblies, subassemblies, structures and/or elements disclosed directly or implicitly herein may be embodied in other specific forms without departing from the spirit or general characteristics thereof, some of which forms have been indicated. Thus, the features described and depicted herein/herewith are to be considered in all respects illustrative and not restrictive with the following brief description of the drawings and their content provided.

DETAILED DESCRIPTION OF THE INVENTION

A versatile, operator configurable launcher system is generally provided. While characterized as a "launcher system," notionally an apparatus is provided to permit a hand held device (e.g., and, without limitation, a "launcher"), having general utility on its own, or general utility on its own with minimal alteration, to be utilized in the context of a frame mounted hand held assembly characterized by an operative combination of the apparatus and the device, and/or to be utilized in the context of an altered operative combination of the apparatus and the device such that a shoulder supported posture/modality for such device may be utilized.

As will be later detailed, the system (FIG. 1 (unassembled) & FIG. 3 (assembled)) is advantageously, but not necessarily, characterized by a grenade launcher, or replica/facsimille thereof (operative or otherwise), a pistol or pistol grip frame, and a stock assembly. Select, no-tool operative unions are contemplated for, between and/or among the elements, i.e., those later described in relation to interfaces A & B, each connoted by ↔ (FIG. 1), whereby, via provisions of a kit or the like, a universal launcher thereof (FIG. 2) may be selectively combined, in the context of a stand-alone/solitary device, with a pistol grip frame, or a pistol grip frame in operative combination with a stock assembly, advantageously, but not necessarily, a "foldable" stock assembly characterized by an extendable butt stock. Select operative union for, between and among the stock assembly and pistol grip frame, which will be later detailed, are generally illustrated with reference to FIGS. 5-9.

Figure 1:
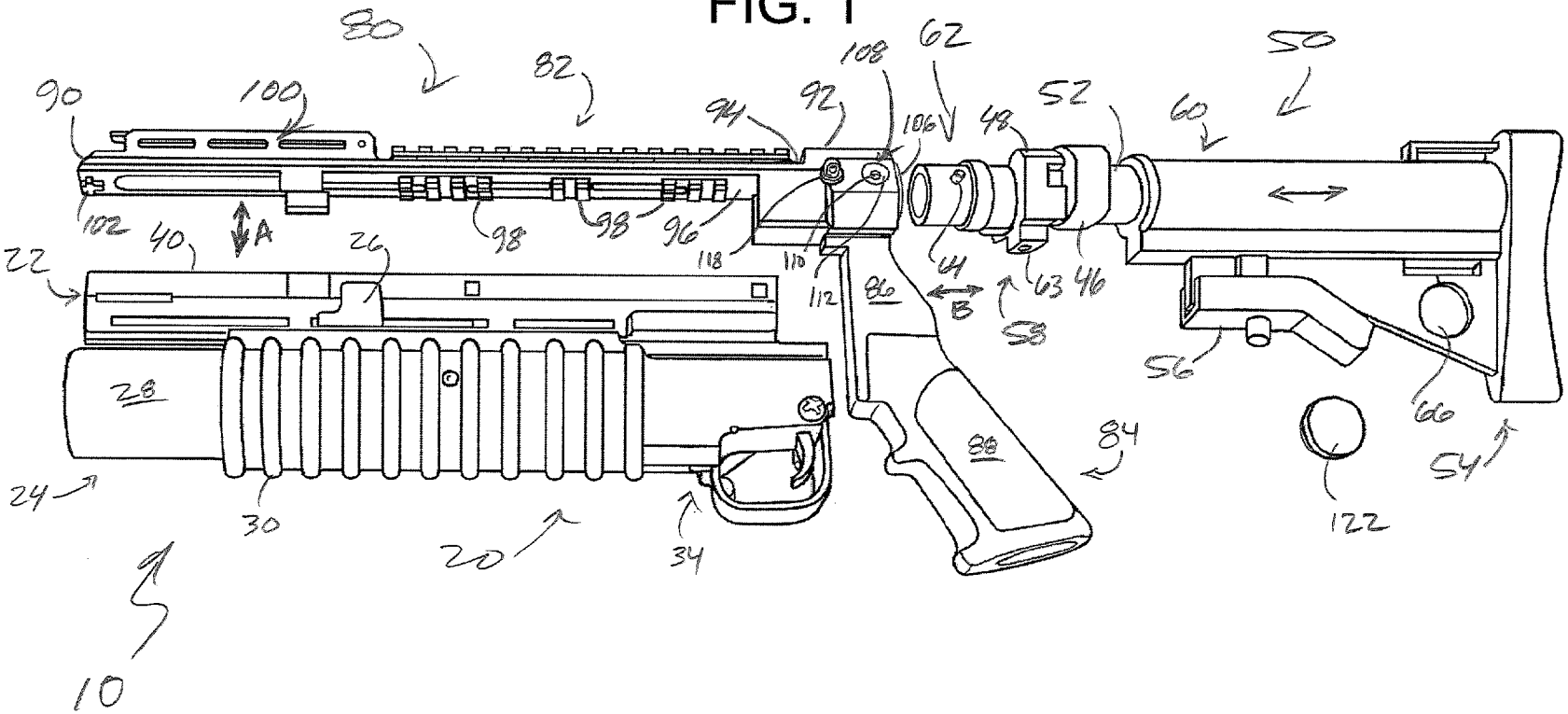
FIG. 1 depicts, left side pictorial view, assembly elements disassociated, a universal launcher system characterized by a launching device, more particularly, a grenade launcher, a pistol grip frame, and a stock assembly.

With reference now to FIG. 1, there is generally shown combinable elements of a grenade launcher system 10, namely, a grenade launcher 20, a stock assembly 50, and a pistol grip frame 80 which essentially hosts at least the launcher, and optionally, the stock assembly. The subject elements are readily operator assembleable and/or configurable.

Generally, the pistol grip frame 80 includes a frame body 82 and a pistol grip 84, characterized by a head 86 and handhold 88, extending therefrom. The frame body 82 includes a first frame body portion 90 adapted for select operative union with the launcher 20, and a second frame body portion 92 adapted for select operative union with stock assembly 50.

Figure 2:
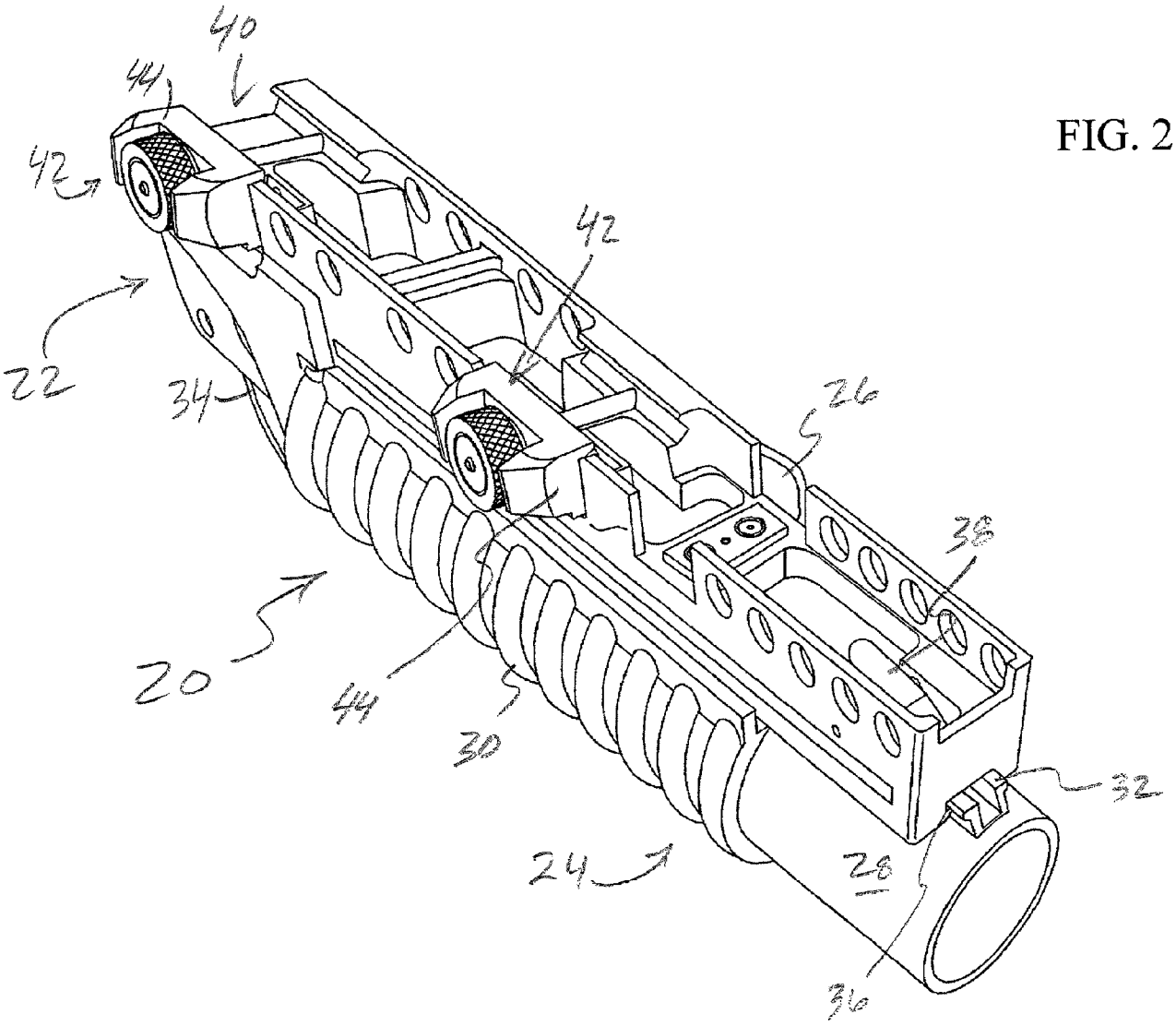
FIG. 2 depicts, slightly from above and front (right) to (left) rear, a right side view of the grenade launcher of FIG. 1, more particularly and without limitation, an M203PI characterized by a universal mounting system.

The grenade launcher is advantageously, but not exclusively, characterized by an enhanced grenade launcher mount (EGLM). More particularly and preferably, provisions for an M203PI EGLM for weapons (or devices) having rails (i.e., an M203PI EGLM for operative, secure, no-tools union with a MIL-STD-1913 rail, a/k/a Picatinny or P-rail, of a weapon/device (WO 2012/099876)), FIG. 2, is provided, primary features thereof subsequently discussed. While the noted launcher structure and configuration is believed advantageous, the nature or character of the interface, as should be readily appreciated, need only be one of reversible affixation in relation to a host device.

As was earlier cited, the utility of Applicant's EGLM was improved via provisions of a tactical mount. The stand alone mount system improved upon the M79 functionality via elimination of, among other things, the bulkiness and cumbersome nature of that weapon system. The compact, light weight stand alone launcher system with a telescoping and folding stock assembly (see e.g., U.S. Pat. No. 7,673,412) provided a improved level of tactical flexibility. Presently, it is believed desirable and advantageous to provide an M203PI universal launcher system, advantageously in a kit format, that combines the rail mountable launcher with a tactical mounting system that can be readily converted to/from a pistol mount (i.e., the tactical mounting system is convertible between exclusive hand held operation, without forend support or with, via, e.g., an M203grip accessory (see e.g., U.S. Pat. No. 7,454,858), and shoulder supported hand held operation).

Figure 3:
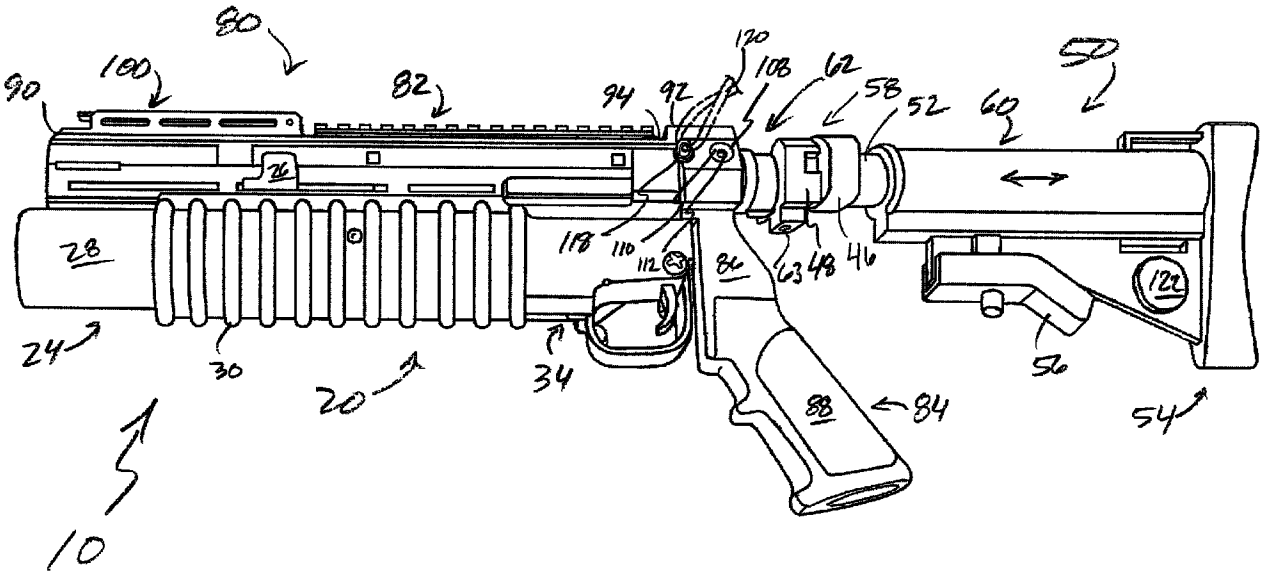
FIG. 3 depicts, left side pictorial view, an assembled universal launcher system comprised of the disassociated elements of FIG. 1.
Figure 4:
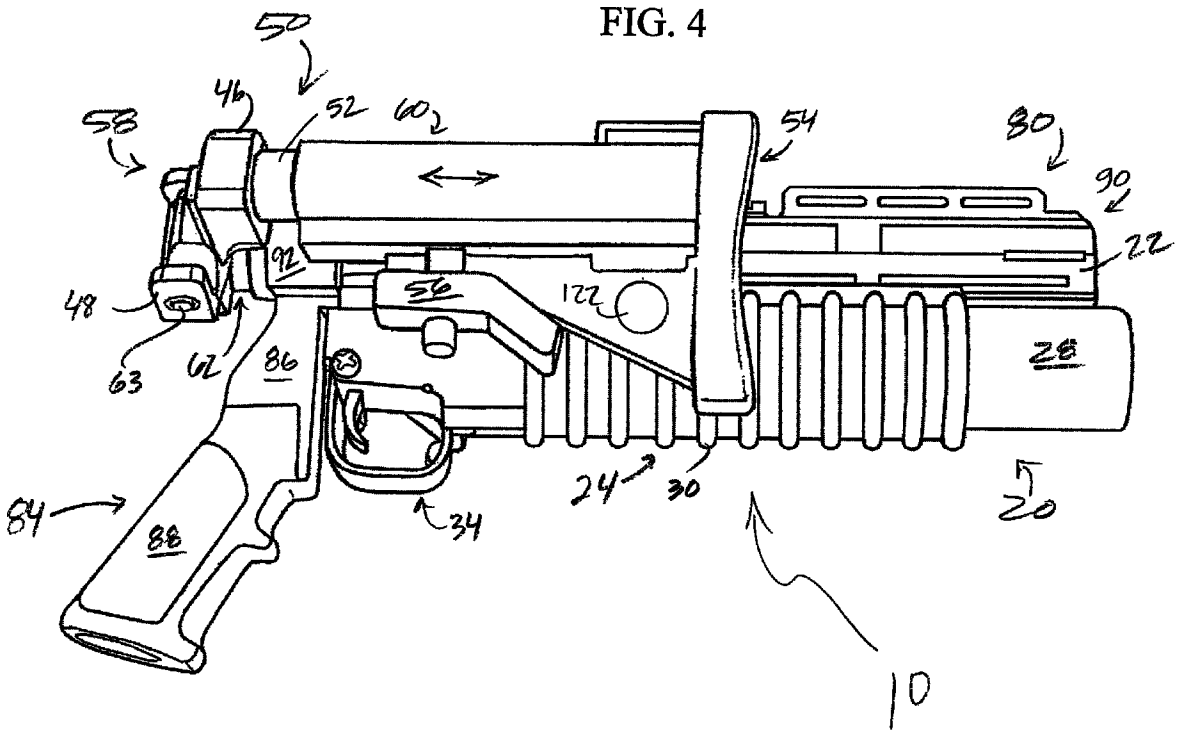
FIG. 4 depicts, right side pictorial view, the universal launcher assembly of FIG. 3, the stock assembly thereof in a compacted/folded (i.e., hingedly "closed") condition or arrangement.
Figure 5:
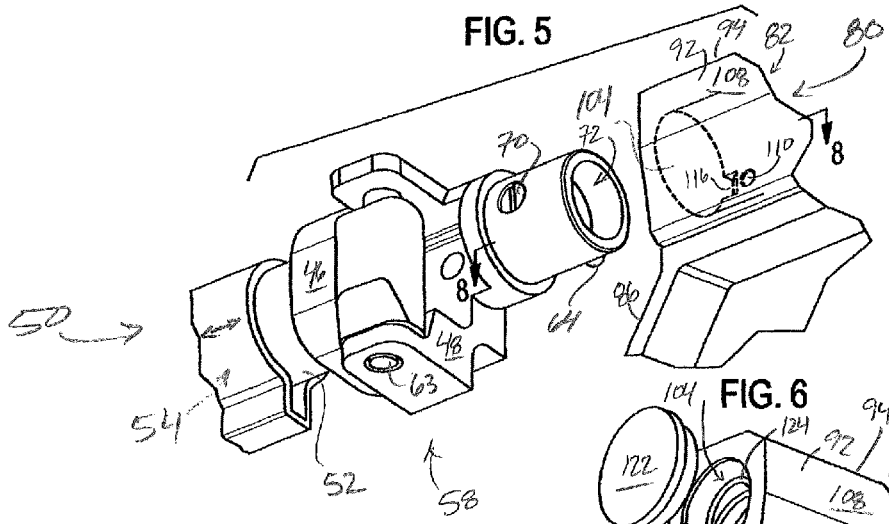
FIG. 5 is a fragmentary exploded perspective as per area "5" FIG. 1, as seen from below, to the right, and to the front, more particularly, a depiction of an operative interface for, between and among the pistol grip frame and the stock assembly.
Figure 6:
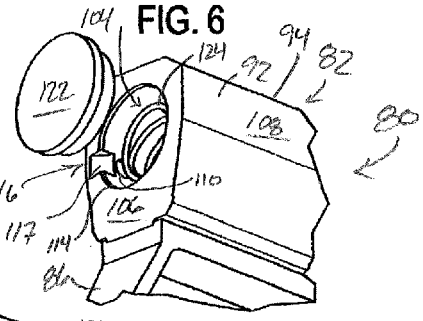
FIG. 6 is a fragmentary perspective view of an end portion of the pistol grip frame showing an orifice cover plug exploded therefrom, seen from below, to the right and to the rear.
Figure 7:
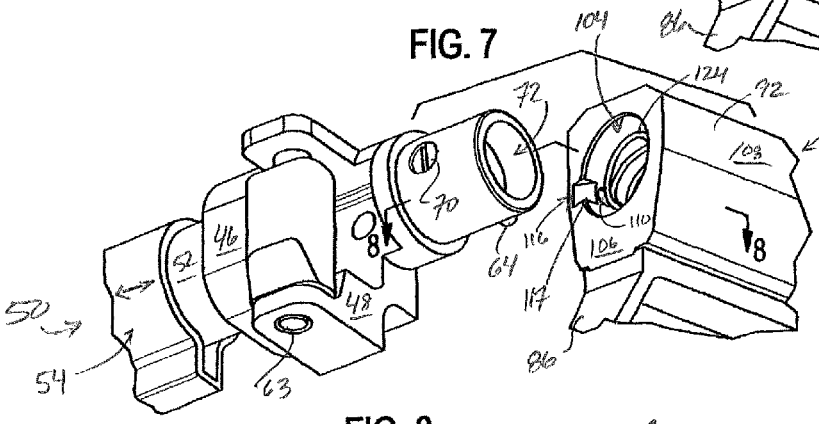
FIG. 7 is a fragmentary perspective view, similar to that of FIG. 5 & FIG. 6, with select subassemblies, namely the pistol grip frame and stock assembly, shown exploded on an angled axis.
Figure 8:
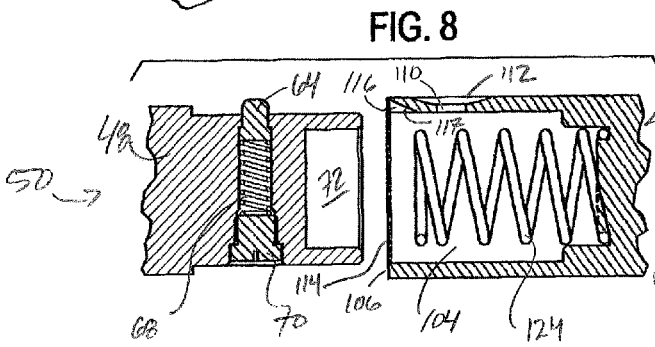
FIG. 8 is a section taken alone line 8-8 in FIG. 5 & FIG. 7; and, FIG. 9 is a section similar to that of FIG. 8 with subassemblies shown operatively united.

With reference now to FIGS. 1, 3 & 4, the contemplated launcher system, e.g., kit (FIG. 1), generally includes a pistol grip frame 80 characterized by frame body 82 and pistol grip 84 extending therefrom, the frame body 82 having a first frame body portion 90 adapted for select operative union with grenade launcher 20 (i.e., interface A), and a second frame body portion 92 adapted for select operative union with stock assembly 50 (i.e., interface B). Both upper 94 and lower 96 portions of first frame body portion 90 include rail (i.e., P-rail) segments 98, with the upper portion 94 of first frame body portions 94, 96 equipped with a sight assembly, more particularly, a centrally positioned forward leaf sight assembly 100. A lug 102 depends from a free end of lower portion 96 of first frame body portion 90 for a mated, registered fit with an upper forward portion of a launcher body 22 of grenade launcher 20. While particulars with regard to second frame body portion 92 of pistol grip frame 90 will be specifically discussed in connection to FIGS. 5-9, preliminary or threshold observations as to features and/or characteristics are generally warranted.

The second frame body portion 92 includes a recess or cavity 104 (see e.g., any of FIGS. 6-8) for reversible receipt of a free end portion of a body 52 of stock assembly 50, more particularly, second frame body portion 92 of pistol grip frame 90 includes a free end/free end "face" 106 adjacent the pistol grip (e.g., adjacent head 86 of the pistol grip 84), the free end including recess or cavity 104 for receipt of the free end portion of body 52 of stock assembly 50. Owing to the free end recess, a free end sidewall 108 is generally defined or delimited for second frame body portion 92 of pistol grip frame 90 (e.g., FIG. 8). A portion of free end sidewall 108, more particularly a lateral portion thereof (FIG. 1), is advantageously characterized by a through-hole 110 and a dimpled area 112 surrounding same (i.e., a localized, e.g., peripheral, surface indentation). A mouth or peripheral portion 114 of free end sidewall 108 includes, in the vicinity of through-hole 110, an interior ramped surface 116 (e.g., see any of FIGS. 6-8) which extends towards and to through-hole 110 from mouth or rim 114 of free end sidewall 108. Moreover, second frame body portion 92 of frame body 82 is advantageously, but not necessarily equipped with an anchor, more particularly, a swivel anchor (i.e., 360° rotatable structure) 118 extends from a side of second frame body portion 92, forwardly adjacent through-hole 110 of sidewall 108, for receipt of a strap, cord etc. 120 (FIG. 3) in furtherance of securing the structure about an operator.

The grenade launcher of the contemplated system, note especially the device of FIG. 2, is generally characterized by a launcher body 22, a barrel assembly 24 operatively supported thereby, and a barrel latch 26 operatively interposed in relation to barrel assembly 24 and launcher body 22 to maintain the barrel assembly 24 in either of an open (not shown) or closed position in furtherance of cartridge ejection/loading. The barrel assembly 24 includes a barrel 28, a ribbed barrel handguard 30, and a barrel rail 32.

With particular reference now to FIG. 2 launcher receiver or body 22 may be fairly characterized by a trigger assembly 34, a barrel rail track 36 for receipt of barrel rail 32, a forward barrel stop 38, and an upper body surface 40 equipped with spaced apart clamping assemblies 42 for reversibly uniting launcher 20 to/with the pistol grip frame 80, more particularly, for clamping launcher 20 to pistol grip frame 80 at/to rail segments 98 of lower portion 96 of first frame body portion 90 thereof. Advantageously, but not exclusively, the clamping assemblies 42 are characterized by self-seating clamping blocks 44, with the upper body surface of the launcher receiver adapted and/or configured so as to permit a supremely secure and robust reversible union for the launcher to/with the rail. Again, while particulars for the universal launcher are set forth herein and (e.g., WO 2012/099876), the launcher of the subject system is not so limited to the depicted structure and/or configuration.

With reference again generally to FIGS. 1, 3 & 4, stock assembly 50, generally adapted for select operative union with second frame body portion 92 of frame body 82 of pistol grip frame 80, is characterized by a body 52 and a stock or butt stock 54. Advantageously, but not necessarily, butt stock 54 is translatable with respect to body 52 so as to be selectively and fixedly positioned in relation to a free end of body 52 so as to suit the needs of an operator. The butt stock, advantageously but not necessarily in the form of a butt stock assembly as shown, also includes an actuator 56 which is selectively engageable with an aperture of spaced apart apertures of apertured keyway (not shown) in furtherance of axial adjustment (↔) of the butt stock by an operator.

Preferably, but not exclusively, as shown (see especially either of FIG. 5 or 7) interposed between the free end of the body and the apertured keyway thereof is a locking hinge or joint assembly 58 about which a distal portion of the stock assembly is "foldable" (FIG. 4), i.e., a distal body portion 60 carries/is equipped with a first hinge portion 59, and a proximal body portion 62 carries/is equipped with a second hinge portion 61, the proximal body portion being pivotable about hinge pin 63. The free end of stock assembly body 52 is adapted so as to be receivable by/at the free end of second frame body portion 92 of frame body 82 of pistol grip frame 80 for reversible fixed union thereto. More particularly, the free end of stock assembly body 52, which advantageously includes a detent 64, is configured for reversible receipt and locked engagement with/within the free end sidewall 108/cavity 104 of second frame body portion 92 of pistol grip frame 80.

With reference now to FIGS. 5-9, particulars of a no-tools robust, interface for, between and among pistol grip frame 80 and stock assembly 50 is generally shown. Structural particulars with regard to the free ends of the second frame body portion of the frame of the pistol grip and the stock body are to be noted.

The free end of second frame body portion 92 of frame body 82 of the pistol grip frame 80, as previously noted, is characterized by recess or cavity 104 which delimits free end sidewall 108. As shown, a cap 122 generally covers cavity entry or mouth 114. Upon removal for operative union with the stock assembly, cap 122 may be readily, handily and securely retained withing an aperture 66 of butt stock 54 (FIGS. 1 & 3). Within cavity 104 of second frame body portion 92, a resilient element, e.g., a spring 124 as shown, is generally housed to tensioningly receive the free end of stock body 52. Although not shown, it should be appreciated that the resilient element is fixedly positioned within the cavity, as by anchoring via mechanical means, e.g., a threaded fastener or the like.

Figure 9:
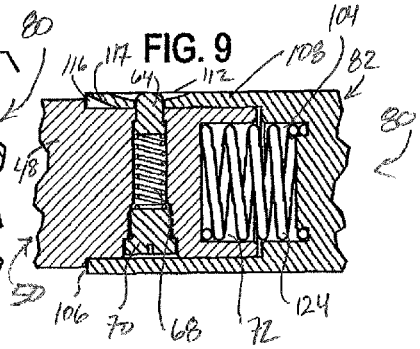

The free end of stock body 52 is generally configured and dimensioned for receipt and retention within cavity 104 of second frame body portion 92. As previously noted, detent 64 tensioningly extends from a surface of the free end of stock body 52 (FIG. 8), via the cooperative interface of a resilient element, e.g., a spring 68 as shown, and a set screw 70 or the like. With sufficient manipulation, detent 64 may be urged toward set screw 70 in furtherance of an operative engagement with through-hole 110 of sidewall 108 of the free end of second frame body portion 92 of frame body 82 of the pistol grip frame 90 (FIG. 9). Advantageously as indicated, the free end of stock body 52 is likewise characterized by a recess 72 for receipt of the free end of spring 124 of cavity 104 of second frame body portion 92 of frame body 82 of pistol grip 80.

To the extent an operator wishes to transition from a hand/pistol based operation/firing to a shoulder based operation/firing, two options are available. First, owing to the folding character of the stock assembly, an operator may readily and easily transition the FIG. 3 system to the system configuration of FIG. 4. Second, in the context of a system configuration characterized by only the launcher and the pistol grip frame, the stock assembly may be readily, reliably and robustly united to such assembly. Subsequent to cap removal (FIG. 6) and hosting by the butt stock, stock assembly 50 is axially aligned for registration with the free end of second frame body portion 92 of frame body 82 of the pistol grip frame 80 (FIGS. 5 & 8), and the ends cooperatively unite (FIG. 9). As is appreciated in connection to FIGS. 8 & 9, as the free ends commence engagement, tensioningly extending detent 64 of the free end of stock body 52 is received by/upon a ramp 117 of interior ramped surface 116 of peripheral portion 114 of free end sidewall 108 so as to load 68 spring underlaying same, and spring 124 of cavity 104 commencing compression. As the engagement proceeds, detent 64 registers with through-hole 110 and is urgingly received thereby, with the relationship for, between and among the elements of the pistol grip frame and the stock assembly as generally indicated in FIG. 9. To reverse the process, an operator need only locate detent 64, which is otherwise protected from inadvertent or unintentional engagement, via what is essentially a recessed condition owing to dimpled area 112 surrounding through-hole 110, and depress same, overcoming the biased condition, such that spring 124 of cavity 104 decompresses (i.e., axially extends) so as to release the stock assembly from the pistol grip frame and urge the former from the latter.

Finally, since the assemblies, subassemblies, devices, structures and/or elements disclosed directly or implicitly herein may be embodied in other specific forms without departing from the spirit or general characteristics thereof, some of which forms have been indicated, the features described and depicted herein/herewith are to be considered in all respects illustrative and not restrictive. For instance, while a grenade launcher 20 is illustrated, e.g., FIG. 1, the nature of the device for integration with pistol grip frame 80 need hardly be so limited, nor need the device be limited to a launching device. Suffice it to say, applicant contemplates a "black box" device which possesses a general or specific utility for integration to with at least structure 80, and advantageously, for integration with the combination of structures 80 & 50, or equivalents thereof, as per FIG. 1. Accordingly, the scope of the subject invention is as defined in the language of the appended claims, and includes not insubstantial equivalents thereto.

That which is claimed:

1. A grenade launcher system comprising:

a. a grenade launcher characterized by a launcher body and a barrel assembly, said barrel assembly translatable in relation to said launcher body in furtherance of cartridge ejection/loading;

b. a pistol grip frame characterized by a frame body and a pistol grip extending therefrom, said frame body having a first frame body portion adapted for select operative union with said grenade launcher, and a second frame body portion adapted for select operative union with a stock assembly, said second frame body portion of said frame body of said pistol grip including a free end adjacent said pistol grip; and, c. a stock assembly adapted for select operative union with said second frame body portion of said frame body of said pistol grip frame, said free end of said second frame body portion of said pistol grip frame including a recess characterized by a resilient element, said recess for tensioned receipt of a free end portion of a body of said stock assembly.

2. The grenade launcher system of claim 1 wherein said launcher body of said grenade launcher includes a clamping assembly for uniting said grenade launcher to/with said first frame body portion of said frame body of said pistol grip.

3. The grenade launcher system of claim 1 wherein said launcher body of said grenade launcher includes a clamping assembly for uniting said grenade launcher to/with a rail segment of said first frame body portion of said frame body of said pistol grip.

4. The grenade launcher system of claim 1 wherein said first frame body portion of said frame body of said pistol grip includes a rail segment, said launcher body of said grenade launcher adapted for operative union with/to said rail segment.

5. The grenade launcher system of claim 1 wherein said first frame body portion of said frame body of said pistol grip includes spaced apart rail segments, said launcher body of said grenade launcher adapted for affixation to rail segments of said spaced apart rail segments.

6. The grenade launcher system of claim 1 wherein said second frame body portion of said frame body of said pistol grip includes a recess for receipt of a free end portion of a body of said stock assembly.

7. The grenade launcher system of claim 1 wherein said second frame body portion of said frame body of said pistol grip includes a free end adjacent said pistol grip, said free end including a recess for receipt of a free end portion of a body of said stock assembly.

8. A grenade launcher system comprising:

a. a grenade launcher characterized by a launcher body and a barrel assembly, said barrel assembly translatable in relation to said launcher body in furtherance of cartridge ejection/loading;

b. a pistol grip frame characterized by a frame body and a pistol grip extending therefrom, said frame body having a first frame body portion adapted for select operative union with said grenade launcher, and a second frame body portion adapted for select operative union with a stock assembly, said second frame body portion of said frame body of said pistol grip including a free end from which said pistol grip depends; and, c. a stock assembly adapted for select operative union with said second frame body portion of said frame body of said pistol grip frame, said free end of said second frame body portion of said pistol grip frame characterized by a recess, defined by a free end sidewall, within which resides a resilient element, said recess for tensioned receipt of a free end portion of a body of said stock assembly.

9. A grenade launcher system comprising:

a. a grenade launcher characterized by a launcher body and a barrel assembly, said barrel assembly translatable in relation to said launcher body in furtherance of cartridge ejection/loading;

b. a pistol grip frame characterized by a frame body and a pistol grip extending therefrom, said frame body having a first frame body portion adapted for select operative union with said grenade launcher, and a second frame body portion adapted for select operative union with a stock assembly, said second frame body portion of said frame body of said pistol grip including a free end from which said pistol grip depends; and, c. a stock assembly adapted for select operative union with said second frame body portion of said frame body of said pistol grip frame, said free end of said second frame body portion of said pistol grip frame characterized by a recess within which resides a resilient element, said recess delimited by a free end sidewall characterized by an aperture, said recess for tensioned receipt of a free end portion of a body of said stock assembly.

10. A grenade launcher system comprising:

a. a grenade launcher characterized by a launcher body and a barrel assembly, said barrel assembly translatable in relation to said launcher body in furtherance of cartridge ejection/loading;

b. a pistol grip frame characterized by a frame body and a pistol grip extending therefrom, said frame body having a first frame body portion adapted for select operative union with said grenade launcher, and a second frame body portion adapted for select operative union with a stock assembly, said second frame body portion of said frame body of said pistol grip includes a free end from which said pistol grip depends; and, c. a stock assembly adapted for select operative union with said second frame body portion of said frame body of said pistol grip frame, said free end of said second frame body portion of said pistol grip frame characterized by a recess within which resides a resilient element, said recess delimited by a free end sidewall characterized by an aperture and a ramped surface, said recess for tensioned receipt of a free end portion of a body of said stock assembly.

11. The grenade launcher system of claim 1 wherein said stock assembly comprises a body and a stock selectively positionable in relation to said body, a free end of said body adapted for reversible union with said free end of said second frame body portion of said frame body of said pistol grip.

12. The grenade launcher system of claim 1 wherein said stock assembly comprises a body and a stock selectively positionable in relation to said body, a free end of said body adapted so as to be receivable by said free end of said second frame body portion of said frame body of said pistol grip for reversible fixed union thereto.

13. A grenade launcher system comprising:

a. a grenade launcher characterized by a launcher body and a barrel assembly, said barrel assembly translatable in relation to said launcher body in furtherance of cartridge ejection/loading;

b. a pistol grip frame characterized by a frame body and a pistol grip extending therefrom, said frame body having a first frame body portion adapted for select operative union with said grenade launcher, and a second frame body portion adapted for select operative union with a stock assembly; and, c. a stock assembly adapted for select operative union with said second frame body portion of said frame body of said pistol grip frame, said stock assembly comprising a body and a stock selectively positionable in relation to said body, a free end of said body including a detent, said second frame body portion of said frame body of said pistol grip including a recess for reversible fixed receipt of said free end of said body of said stock assembly.

14. A grenade launcher system comprising:

a. a grenade launcher characterized by a launcher body and a barrel assembly, said barrel assembly translatable in relation to said launcher body in furtherance of cartridge ejection/loading;

b. a pistol grip frame characterized by a frame body and a pistol grip extending therefrom, said frame body having a first frame body portion adapted for select operative union with said grenade launcher, and a second frame body portion adapted for select operative union with a stock assembly; and, c. a stock assembly adapted for select operative union with said second frame body portion of said frame body of said pistol grip frame said stock assembly comprising a body and a stock selectively positionable in relation to said body, a free end of said body including a detent, said second frame body portion of said frame body of said pistol grip having a free end including a recess housing a resilient element, said recess for reversible locked tensioned receipt of said free end of said body of said stock assembly.

15. The grenade launcher system of claim 1 wherein said stock assembly is characterized by a locking hinge, a distal stock assembly portion thereby positionable between either of a stowed or operative configuration.

16. A grenade launcher system comprising:

a. a grenade launcher characterized by a launcher body and a barrel assembly, said barrel assembly translatable in relation to said launcher body in furtherance of cartridge ejection/loading;

b. a pistol grip frame characterized by a frame body and a pistol grip extending therefrom, said frame body having a first frame body portion adapted for select operative union with said grenade launcher, and a second frame body portion adapted for select operative union with a stock assembly, said second frame body portion including a recessed free end; and, c. a stock assembly adapted for select operative union with said second frame body portion of said frame body of said pistol grip frame, said stock assembly including a body and a stock supported thereby, an end portion of said body of said stock assembly including a detent, said recessed free end of said second frame body portion including a through hole for receipt and retention of said detent in furtherance of uniting said stock assembly to/with said pistol grip.

17. The grenade launcher system of claim 16 wherein a recess of said recessed free end of said second frame body portion houses a resilient element for tensioned receipt of said end portion of said body of said stock assembly.

18. The grenade launcher system of claim 17 wherein said body of said stock assembly includes a locking hinge to establish either of a stowed or operative configuration for said stock of said stock assembly.

* * * * *